US006850151B1

(12) United States Patent
Calhoun et al.

(10) Patent No.: US 6,850,151 B1
(45) Date of Patent: Feb. 1, 2005

(54) DEVICES FOR LOCATING/KEEPING TRACK OF OBJECTS, ANIMALS OR PERSONS

(76) Inventors: Ricky R. Calhoun, 6712 Santa Monica Blvd., Shreveport, LA (US) 71119; Nathaniel Petterway, 4232 Chamberlain Dr., Shreveport, LA (US) 71109

( * ) Notice: Subject to any disclaimer, the term of this patent is extended or adjusted under 35 U.S.C. 154(b) by 85 days.

(21) Appl. No.: 10/374,653

(22) Filed: Feb. 26, 2003

(51) Int. Cl.[7] ..... G08B 1/00

(52) U.S. Cl. ..... 340/309.16; 340/539.1; 340/7.6; 340/7.61; 340/7.62

(58) Field of Search ..... 340/539.1, 539.11, 340/539.13, 7.58, 7.6, 7.61, 7.62, 309.16, 571, 572.1, 825.36, 825.49

(56) References Cited

U.S. PATENT DOCUMENTS

| | | | | | |
|---|---|---|---|---|---|
| 4,872,005 | A | * | 10/1989 | DeLuca et al. | 340/7.41 |
| 5,245,314 | A | | 9/1993 | Kah, Jr. | 340/539.13 |
| 5,289,163 | A | | 2/1994 | Perez et al. | 340/539.32 |
| 5,337,041 | A | | 8/1994 | Friedman | 340/573.4 |
| 5,652,569 | A | | 7/1997 | Gerstenberger | 340/573.4 |
| 5,790,022 | A | | 8/1998 | Delvecchio et al. | 340/539 |
| 5,841,352 | A | | 11/1998 | Prakash et al. | 340/573.4 |
| 5,844,487 | A | | 12/1998 | Britt | 340/573.4 |
| 5,883,576 | A | | 3/1999 | De La Huerga | 340/573.1 |
| 5,929,747 | A | * | 7/1999 | Rosenblatt et al. | 340/309.7 |
| 6,018,289 | A | * | 1/2000 | Sekura et al. | 340/309.4 |
| 6,111,508 | A | | 8/2000 | Enson et al. | 340/573.2 |
| 6,127,931 | A | | 10/2000 | Mohr | 340/573.4 |
| 6,166,642 | A | | 12/2000 | Farshid | 340/573.1 |
| 6,278,370 | B1 | * | 8/2001 | Underwood | 340/573.1 |
| 6,313,733 | B1 | | 11/2001 | Kyte | 340/7.22 |
| 6,326,891 | B1 | | 12/2001 | Lin | 340/573.4 |
| 6,344,797 | B1 | | 2/2002 | Hoshy | 340/573.1 |
| 6,535,120 | B1 | * | 3/2003 | Sebanc et al. | 340/505 |
| 6,664,896 | B2 | * | 12/2003 | McDonald et al. | 340/572.1 |
| 6,674,364 | B1 | * | 1/2004 | Holbrook et al. | 340/568.1 |

* cited by examiner

*Primary Examiner*—Toan N. Pham
(74) *Attorney, Agent, or Firm*—R. Keith Harrison

(57) ABSTRACT

Devices for enabling a user to locate an object, animal or person or reminding the user of the location of an object, animal or person. In a non-transmitter/receiver embodiment, the device includes at least one alert mechanism which is connected to a digital clock or other timer and microprocessor which times transmission of alert signals emitted from the alert mechanism or mechanisms. The operational components of the device may be contained in a housing which is attached to the object, animal or person to be located. In a remote transmitter/receiver embodiment, the device includes a transmitter which transmits activation signals at preset times to activate an alert feature of a paired remote receiver which is provided on the object, animal or person to be located or tracked. The transmitter may include an on-command button for manual transmission of the activation signals to the receiver. The receiver may have a visible alert mode in combination with a selected audible or vibratory alert mode. In an on-board transmitter/receiver embodiment, the device includes a transmitter which is housed together with a receiver in a single unit. In that case, the transmitter of one unit can transmit preset timed activation signals to the receiver of a different unit which is placed on the object, animal or person. Alternatively, the transmitter of one unit can transmit preset timed activation signals to the receiver of the same unit placed on the object, animal or person.

18 Claims, 17 Drawing Sheets

12

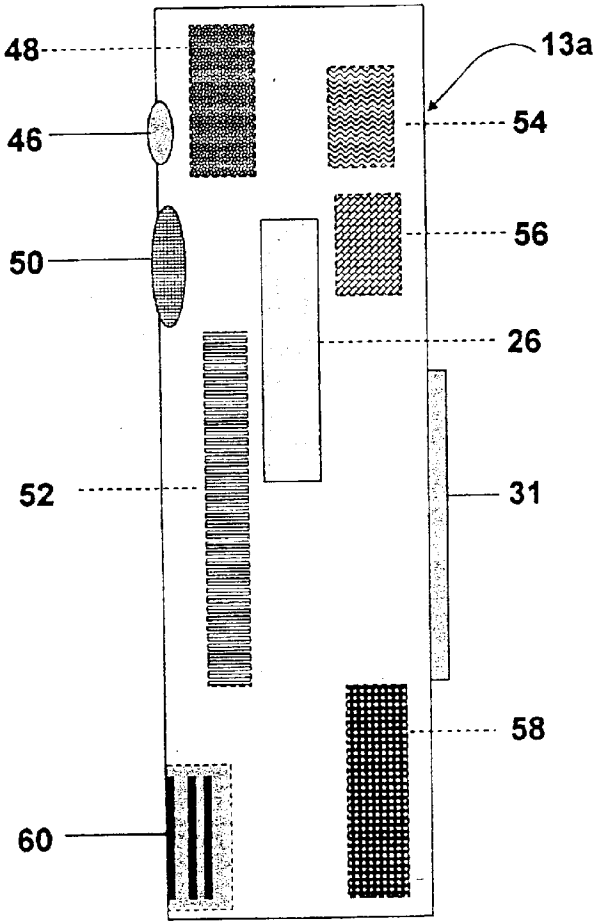
FIG 9
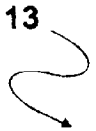

Transmitter & Receiver Units

S12 Grasp TRANSMITTER of device and set the power switch to the "ON" position.

S14 Depress Mode button to enter menu of the transmitter unit and scroll to "Set Time"; use the mode button and set button in combination to make settings to the clock of the transmitter unit to set current time. Repeat the same scrolling to "Set Call" to enter a preset "Call" times. The transmitter unit is now ready for use.

S16 Grasp RECEIVER of device and set power switch to the On position.

S18 Set Alert Mode Switch of the receiver unit to "Audible or Vibratory" the visible alert has the default setting of always "ON" and will activate along with your "Audible or Vibratory" setting of choice.

S20 Depress the Set button and hold until Visible alert begins to flash. The Receiver is now in the Learn mode to learn the signal of the transmitter unit.

S22 Grasp TRANSMITTER of device and depress the "Call" button. This attaches the Receiver to the Digital signal of the Transmitter. Visible alert of the receiver unit now stops flashing. Depress the "on command Call" button on the transmitter unit again to test. The receiver unit will begin selected, along with visible alerting. Depress the set button on the transmitter unit to stop alerting signal. The receiver unit will now receive the signal of the transmitter unit and is ready for use.

S24 Secure the device to objects/persons/animals to be reminded of and/or located.

FIG 11

Basic Model Unit

S2 Grasp the device; turn on power switch. Depress Mode button to enter menu and scroll to "Set Time"; use the mode button and set button in combination to make settings to the clock and times of preset alerts, set current time.

S4 Again, depress Mode button to enter menu of the device scroll to "Set Call" to enter preset "alert" times. The device is now ready for use.

S6 Set Alert Mode Switch of the device to "Audible or Vibratory"; the visible alert has the default setting of always "ON" and will activate along with your setting of choice.

S8 Secure the device to objects/persons/animals to be reminded of and/or located.

FIG 12

Transmitter / Receiver Unit

S26 Grasp device and set the transmitter power switch to the "ON" position.

S28 Depress Mode button to enter menu of the transmitter and scroll to "Set Time"; use the mode button and set button in combination to make settings to the clock of the transmitter to set current time. Repeat the same scrolling to "Set Call" to enter a preset "Call" times. The transmitter is now ready for use.

S30 Move to the RECEIVER of the device and set receiver power switch to the On position.

S32 Set Alert Mode Switch of the receiver to "Audible or Vibratory"; the visible alert has the default setting of always "ON" and will activate along with your "Audible or Vibratory" setting of choice.

S34 Depress the set button and hold until Visible alert begins to flash. The Receiver is now in the Learn mode to learn the signal of the transmitter.

S36 At the transmitter of the device depress the on command "Call" button. This attaches the Receiver to the Digital signal of the Transmitter. Visible alert of the receiver now stops flashing. Depress the on command "Call" button on the transmitter again to test. The receiver will begin selected, along with visible alerting. Depress the set button on the transmitter to stop alerting signal. The receiver will now receive the signal of the transmitter and is ready for use.

S38 Secure the device to objects/persons/animals to be reminded of and/or located.

FIG 13

DEVICES FOR LOCATING/KEEPING TRACK OF OBJECTS, ANIMALS OR PERSONS

FIELD OF THE INVENTION

The present invention relates to devices for locating or keeping track of objects, animals or persons. More particularly, the present invention relates to devices which emit timed alarm signals to assist a user in locating or keeping track of the location of various objects such as cell phones, pagers, laptop computers and keys; animals such as pets; or persons such as toddlers or small children, for example.

BACKGROUND OF THE INVENTION

Numerous types of locating devices are known in the art for locating or keeping track of objects, persons or animals. These devices typically include a receiver which is positioned on the object, person or animal while a transmitter for typically manual activation by the receiver is held or worn by a searcher or operator. Such devices require the operator to manually transmit an activation signal from the transmitter to the paired receiver, which emits an alarm or other signal. These devices are typically incapable of hands-free activation, and while the devices may be suitable for the particular purposes for which they were designed, they are not suitable for the purposes of the present invention.

It is thus desirable to provide a device which is capable of hands-free operation and includes a transmitter which transmits signals at preset times to activate an alert feature of a paired remote receiver which is provided on the object, animal or person to be located or tracked. The transmitter may include an on-command button for manual transmission of the signals to the receiver. The receiver may have a selected audible, visible or vibratory alert mode. The device may be used to remind a user of the location of an object, person or animal at a preset time. For example, the location of the user's car keys or cellular phone may be verified using the device. Additionally, the device may be used to remind the user to take a pet outside or feed a pet before leaving home. The transmitter of the device may be preset to send the activation signal or signals to the paired remote receiver at the desired time or times, thereby activating the receiver's alert feature in the alert mode which may be audible, visual or vibratory. The devices may be easily secured to the object, animal or person of concern. It is further desirable to provide a device which does not require a transmitter or receiver with audible, visible and vibratory alerting. It is yet further desirable to provide a device which has a third configuration in which a transmitter is housed together with a receiver in a single unit. In that case, the transmitter of one unit can transmit preset timed activation signals to the receiver of a different unit which is placed on the object, animal or person. Alternatively, the transmitter of a unit can transmit preset timed activation signals to the receiver of the same unit placed on the object, animal or person.

SUMMARY OF THE INVENTION

The present invention relates generally to digital locating devices, and more specifically, to devices which are able to make hands-free preset calls or alerts reminding a user of the location of an object, person or animal or enabling the user to keep track the location of the object, person or animal at preset times.

A primary object of the present invention is to provide a device for enabling a user to locate an object, person or animal or for reminding the user of the location of an object, person or animal.

Another object of the present invention is to provide a device for enabling a user to locate an object, person or animal or for reminding the user of the location of an object, person or animal at preset times in both a non-transmitter/non-receiver embodiment as well as a remote transmitter/receiver embodiment and an embodiment in which a transmitter and a receiver are housed together in the same unit.

A further object of the present invention is to provide a device for enabling a user to locate an object, person or animal or for reminding the user of the location of an object, person or animal that can remind or verify the location of an object, person or animal using preset timed activation signals or using an on-command button feature on the receiver/transmitter embodiment.

A further object of the present invention is to provide a device for enabling a user to locate an object, person or animal or for reminding the user of the location of an object, person or animal, which device has multiple uses such as reminding a user to check the security of a door or window before leaving home or retiring to bed for the night.

A further object of the present invention is to provide a device for enabling a user to locate an object, person or animal or for reminding the user of the location of an object, person or animal, which device offers hands-free operation using a preset timed feature.

A still further object of the present invention is to provide a device for enabling a user to locate an object, person or animal or for reminding the user of the location of an object, person or animal, which device is capable of storing several preset alert times.

Another object of the present invention is to provide a device for enabling a user to locate an object, person or animal or for reminding the user of the location of an object, person or animal, which device is simple and easy to use.

A still further object of the present invention is to provide a device for enabling a user to locate an object, person or animal or for reminding the user of the location of an object, person or animal, which device is economical in cost to manufacture.

Additional objects of the present invention will appear as the description proceeds.

A device for enabling a user to locate an object, person or animal or for reminding the user of the location of an object, person or animal is disclosed by the present invention. The device includes a non-transmitter/receiver embodiment that can be used as a reminder or aid in locating or verifying the location of the object, person or animal. It offers simplicity in structure and use. The non-transmitter/receiver embodiment gives preset "alerts" at desired times by an on-board internal digital electronic clock and microprocessor, by several alerting means (visual and/or audible and/or vibratory). The audible alerting means may be audio messages or music, for example. The visual alerting means may be a flashing display, for example. The alert mode may include a set button to reset or terminate the alert mode, and the alerting means may be activated according to preset timed intervals such as every fifteen seconds, for example. The device includes another embodiment which provides a remote receiver and transmitter. The transmitter includes an on-board digital electronic clock and microprocessor which provides transmittable preset "calls" or activation signals to the receiver at desired preset times, and may include an on-command button for on-command "calls" or activation signals to the receiver. The receiver uses any, some or all of a variety of alerting means such as visual, audible, vibratory, buzzers, audio messages, or music, and/or visual means such as a flashing display. As with the first embodiment, the alert mode may include a set button to reset or terminate the alert mode, and the alerting means may be activated according to preset timed intervals such as every fifteen seconds, for example. Yet a third embodiment includes a transmitter and a receiver housed together in the same casing or housing, with transmittable preset "calls" or activation signals made from the transmitter to the receiver via the transmitter's on-board internal digital electronic clock and microprocessor to make "calls" or activation signals to the on-board receiver or to a remote receiver at preset desired times. The transmitter may further include an "on command" button which may be activated manually by the user to transmit the activation signal from the transmitter to the on-board receiver or remote receiver. The on-board or remote receiver uses any, some or all of a variety of alerting means such as visual, audible, vibratory, buzzers, audio messages, or music, and/or visual means such as a flashing display. As with the first two embodiments, the alert mode may include a set button to reset or terminate the alert mode, and the alerting means may be activated according to preset timed intervals such as every fifteen seconds, for example.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 9 is a top view of the receiver unit of FIG. 8;

FIG. 11 is a flow diagram illustrating use of the remote transmitter/receiver unit embodiment of the devices of the present invention;

FIG. 12 is a flow diagram illustrating use of the non-transmitter/receiver unit embodiment of the devices of the present invention;

FIG. 13 is a flow diagram illustrating use of the on-board transmitter/receiver embodiment of the devices of the present invention;

DETAILED DESCRIPTION OF THE PREFERRED EMBODIMENTS

Figure 2:
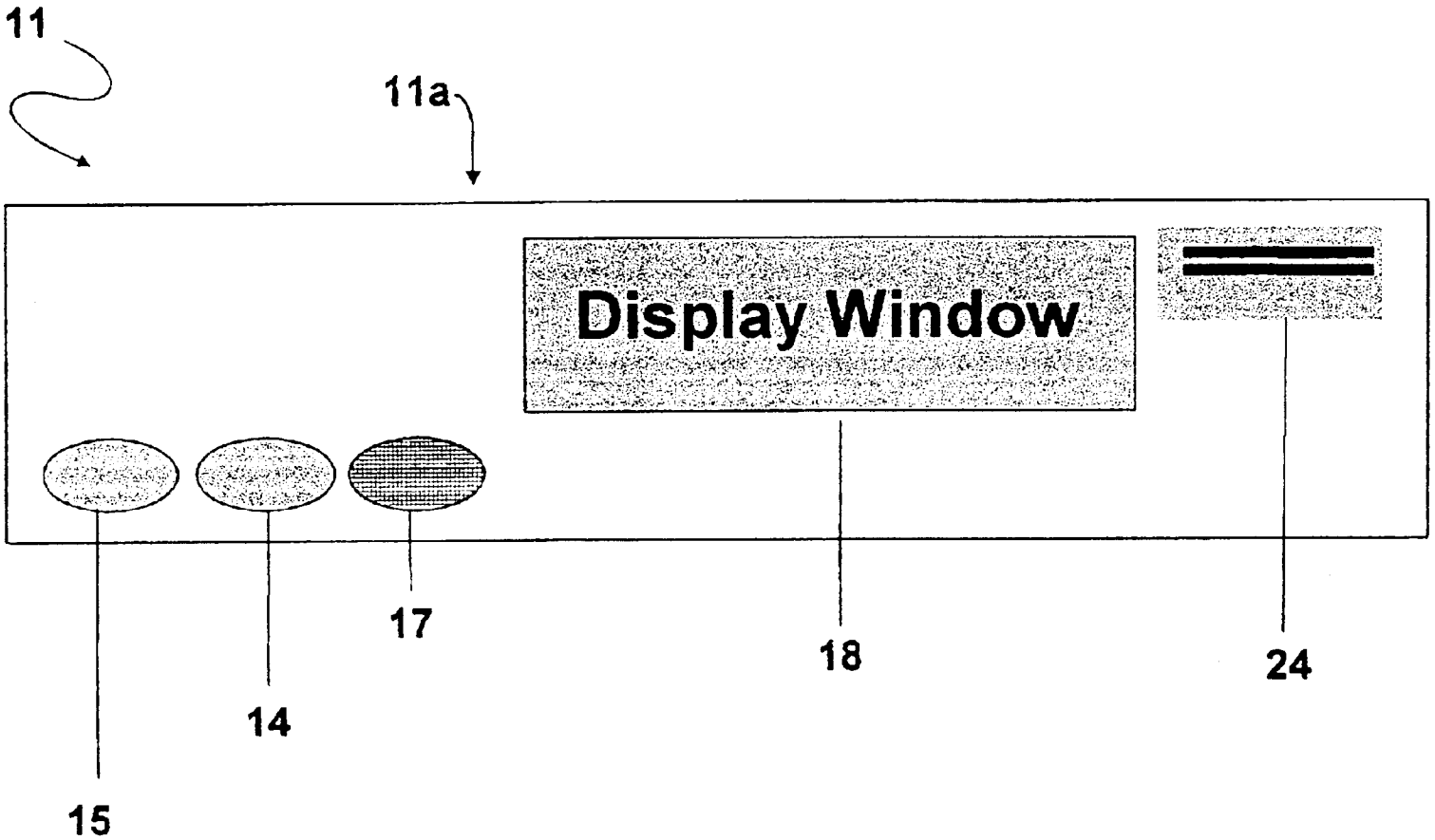
FIG. 2 is a front view of a non-transmitter/receiver embodiment of the devices of the present invention.
Figure 3:
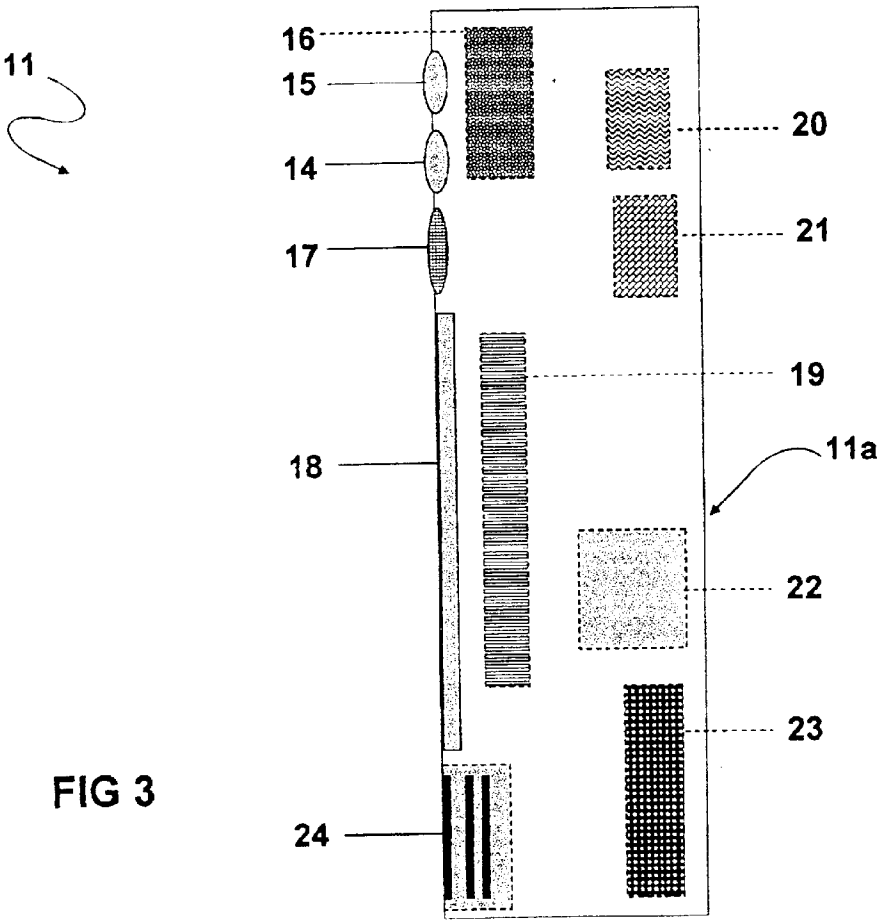
FIG. 3 is a top view of the device of FIG. 2.
Figure 4:
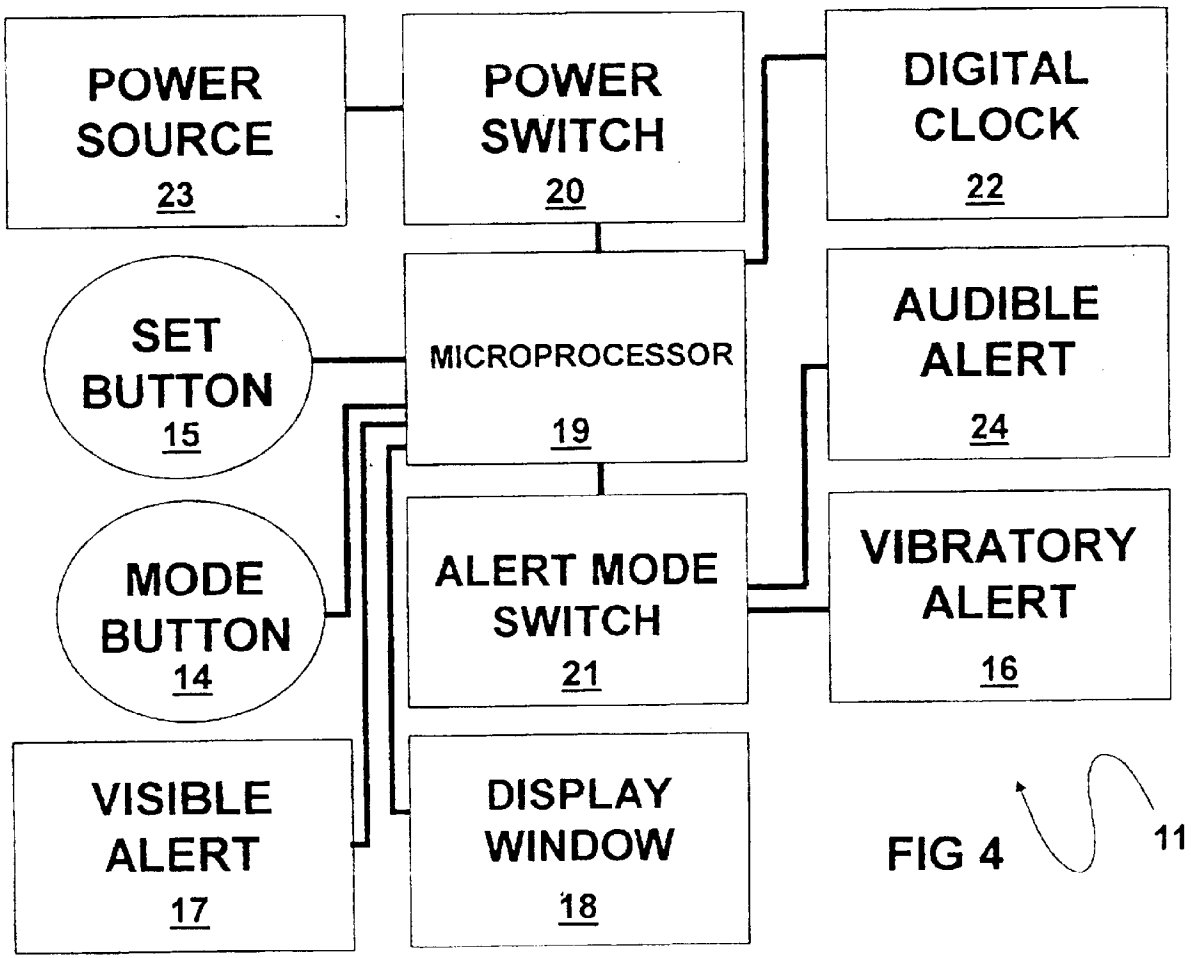
FIG. 4 is a block diagram of the device of FIGS. 2 and 3.

Turning now descriptively to the drawings, in which similar reference characters denote similar elements throughout the several views, FIGS. 2–4 illustrate a non-transmitter/receiver embodiment of the devices of the present invention. The non-transmitter/receiver embodiment of the devices is generally indicated by reference numeral 11. As shown in FIGS. 2 and 3, the device 11 typically includes a housing 11*a* which houses or supports the various operational elements of the device 11, which operational elements will be hereinafter described with respect to FIG. 4. As shown in FIG. 4, the device 11 includes a microprocessor 19, to which is operably connected a power source 23, such as a battery, through a power switch 20 which is used to selectively supply electrical power to the microprocessor 19 and turn the device 11 on and off, as hereinafter further described. A display window 18, operably connected to the microprocessor 19, is provided on a face of the housing 11*a*, as shown in FIG. 2, and provides a viewing of preset date, time and time interval settings for alert signals programmed into the microprocessor 19, as hereinafter further described. A visible alert 17 is typically connected to the microprocessor 19 and is provided on the housing 11*a*, as shown in FIG. 2. Various other alert mechanisms such as a vibratory alert 16 and/or an audible alert 24 may additionally be connected to the microprocessor 19 typically through an alert mode switch 21 which is used to select among the vibratory alert 16 and the audible alert 24 as well as any additional alert mechanisms (not shown) connected to the microprocessor 19 through the alert mode switch 21. A mode button 14 is connected to the microprocessor 19 for scrolling a menu of the microprocessor 19 as shown in the display window 18. A set button 15 is connected to the microprocessor 19 to enable a user to select menu options and enter settings and selections into the microprocessor 19. The set button 15 may also be manually depressed to selectively terminate a timed alert mode of the device 11, as hereinafter further described. A digital clock 22 is further connected to the microprocessor 19 to enable the microprocessor 19 to control the date and time of alert signals emitted by the visible alert 17 and the vibratory alert 16 or the audible alert 24, as well as the length of the time interval to elapse between successive alert signals. The digital clock 22 may be set typically by depression of the mode button 14 and the set button 15, as hereinafter further described.

A typical arrangement of the various control features on the housing 11*a* of the device 11 is shown in FIGS. 2 and 3. Accordingly, the mode button 14, the set button 15 and the visible alert 17 may be provided together on the front face of the housing 11*a*, along with the display window 18 and the audible alert 24. However, it is understood that the relative positional arrangements of these control elements on the housing 11*a* is merely illustrative and the elements may have any desired arrangement to facilitate ease in using the device 11.

Referring next to FIGS. 2–4 and 12, in typical operation the device 11 is used to locate an animal, object or person (not shown) such as a toddler or to remind a user of the location of the animal, object or person after a preset period of time. Accordingly, the device 11 is first activated by supplying electrical power from the power source 23 to the microprocessor 19, by manipulating the power switch 20 to the "on" position, as described in step S2 in FIG. 12. Next, the mode button 14 is depressed to scroll a menu for the microprocessor 19 as displayed on the display window 18. The menu typically includes such options as time settings for the digital clock 22, date and time settings for an alert signal or signals to be emitted by the visible alert 17 and the vibratory alert 16 or the audible alert 24, as well as the desired length of time to elapse between successive alert signals. Accordingly, the "clock time settings" mode for setting the current time for the digital clock 22 is first selected in the menu shown in the display window 18 by depressing the mode button 14, after which the desired date, hour and minutes for the digital clock 22 are set using the set button 15. Next, as described in step S4 of FIG. 12, the "alert date settings" mode for the alert signals to be emitted from the device 11 is selected by depressing the mode button 14, after which the desired date for the alert signals to begin are set using the set button 15. Next, the "alert time settings" mode including a menu of available times for the alert signals to begin is scrolled in the display window 18 by again depressing the mode button 14, after which the desired time for the alert signals to begin are set using the set button 15. Next, an "alert timing" mode for selecting the available lengths of time between successive alert signals, typically in seconds, is scrolled on the menu by depressing the mode button 14 as the available time interval lengths are displayed on the display window 18. When the desired time interval length (for example, 15 seconds) appears in the display window 18, that time interval length is selected and programmed into the microprocessor 19 by depressing the set button 15. Finally, as described in step S6 of FIG. 12, the alert mode switch 21 may be used to select among the vibratory alert 16 or the audible alert 24 to be used typically in addition to the visible alert 17. The visible alert 17 typically has a default setting of "always on" and is activated along with the selected vibratory alert 16 or audible alert 24. Accordingly, the device 11 is programmed to begin emitting the visible alert signals from the visible alert 17, as well as the vibratory alert signals from the vibratory alert 16 or the auditory alert signals from the audible alert 24, as selected using the alert mode switch 21, at the date and time programmed into the microprocessor 19. As shown in step S8 of FIG. 12, the device 11 is then attached to the object, person or animal (not shown) typically using loop-pile fasteners, loops, straps or any other suitable mechanism for removably fastening the device 11 onto the object, person or animal. On the date and at the time which were previously programmed into the microprocessor 19 to begin emission of the alert signals from the device 11, the microprocessor 19 matches the actual date and time as indicated by the digital clock 22 with the preset or programmed date and time for initiating emission of the alert signals from the device 11. Accordingly, the visible alert 17 emits the visible alert signals and the vibratory alert 16 or the audible alert 24 successively emits the vibratory or auditory alert signals, respectively, at the spaced time interval programmed into the microprocessor 19. In this case, the alert signals are emitted from the device 11 every 15 seconds. When the object, person or animal is found by the user, the set button 15 is typically depressed to terminate further emission of the alert signals from the visible alert 17 and the vibratory alert 16 or the audible alert 24. Upon subsequent depression of the set button 15, the device 11 is primed to be programmed for re-use.

Figure 1:
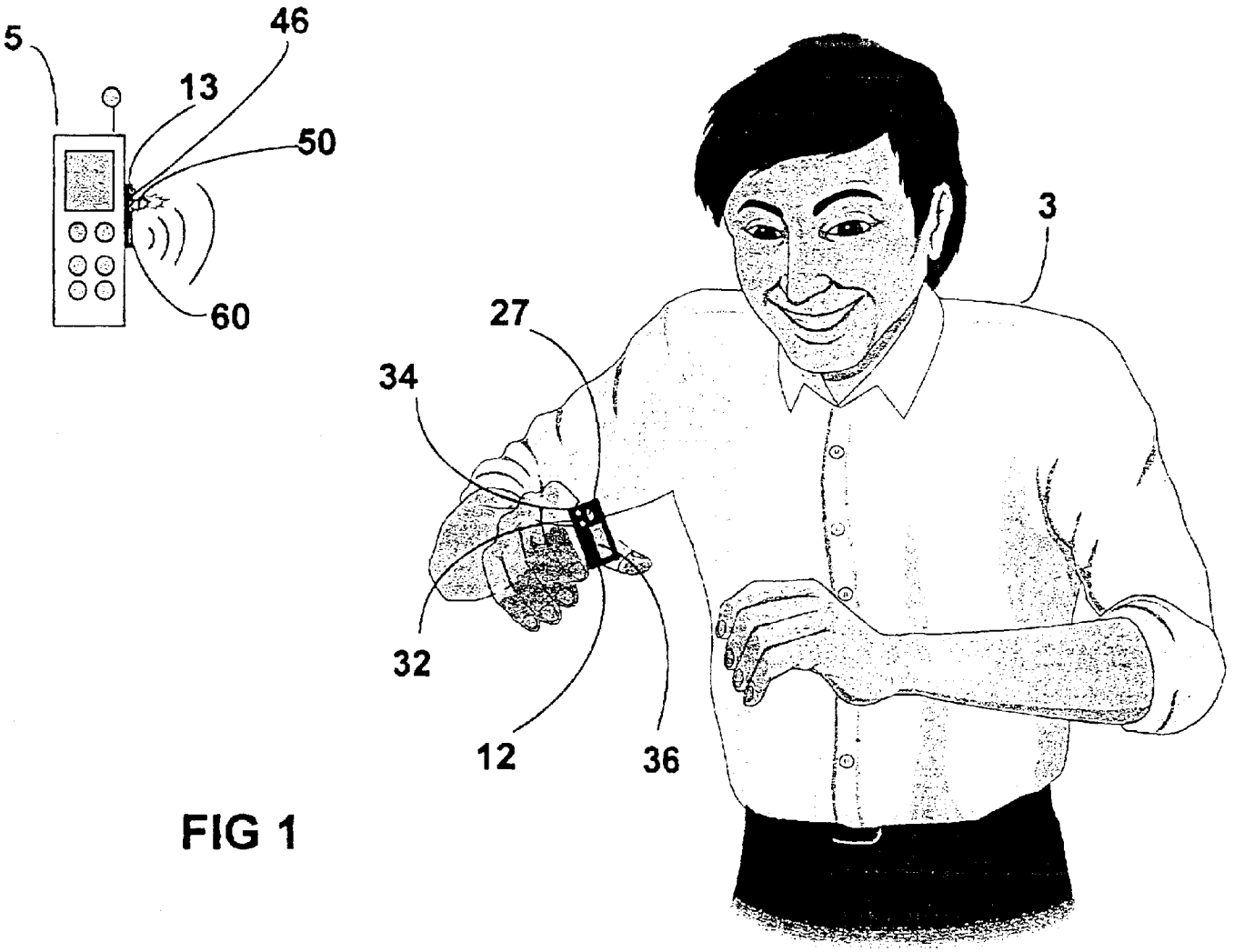
FIG. 1 is a perspective view of a cellular phone with a receiver unit of a remote transmitter/receiver embodiment of the devices of the present invention attached to the phone, with a user using the transmitter unit of the device to activate the receiver.

Referring next to FIGS. 1 and 5–11, a remote transmitter/receiver embodiment of the devices of the present invention includes a transmitter unit 12 and a receiver unit 13. In use, as shown in FIG. 1 and hereinafter described, the transmitter unit 12 is held by a user 3 and the receiver unit 13 is attached to a cell phone 5 or other object or a person or animal in order to enable the user 3 to locate the object, person or animal or to remind the user 3 of the location of the object, person or animal. The transmitter unit 12 emits activation signals to the receiver unit 13 at preset times and at preset time intervals, and typically further includes an on-command feature for emitting on-command activation signals to activate the receiver unit 13, as hereinafter further described.

Figure 5:
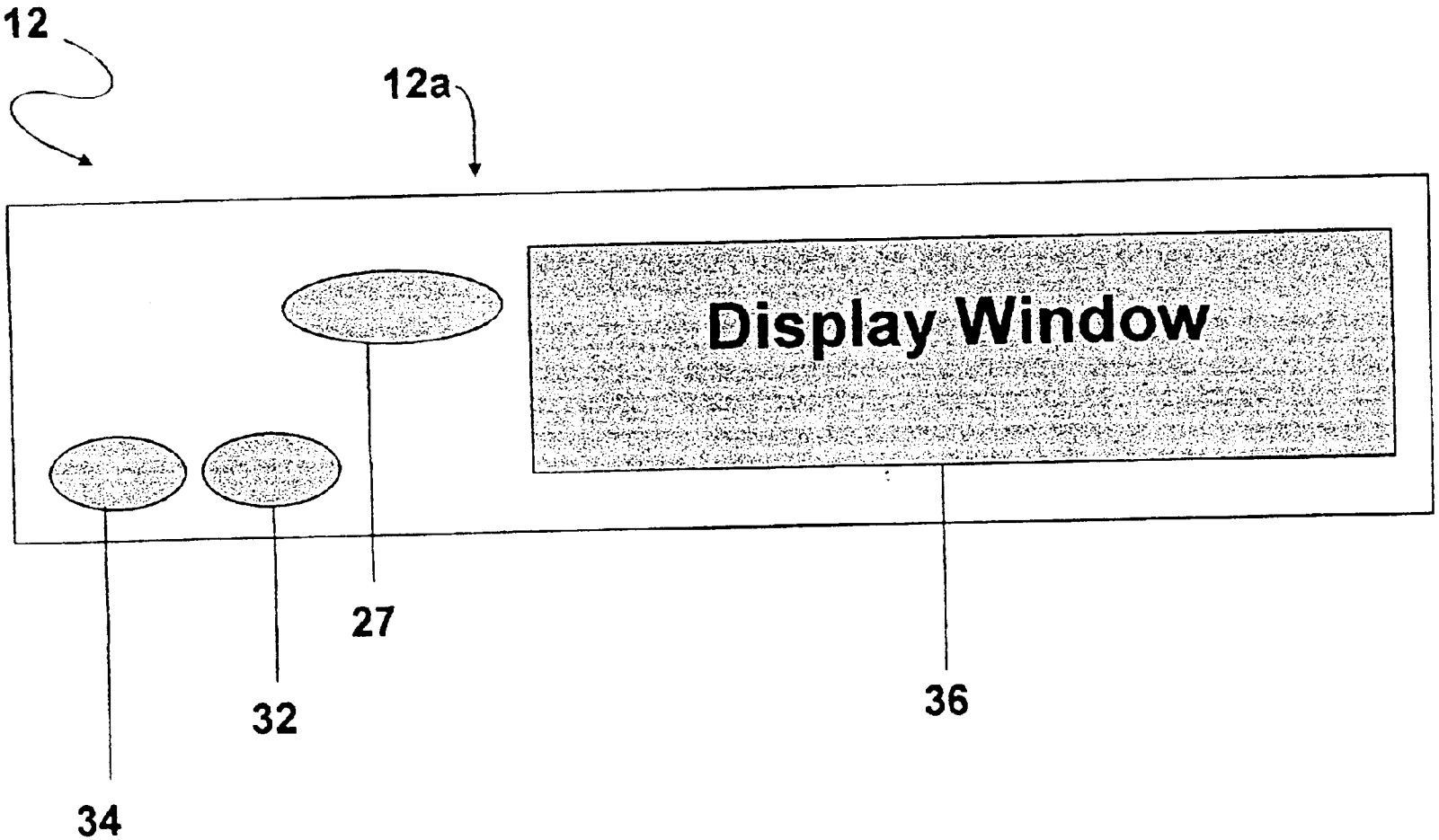
FIG. 5 is a front view of a transmitter unit of a remote transmitter/receiver embodiment of the devices of the present invention.
Figure 6:
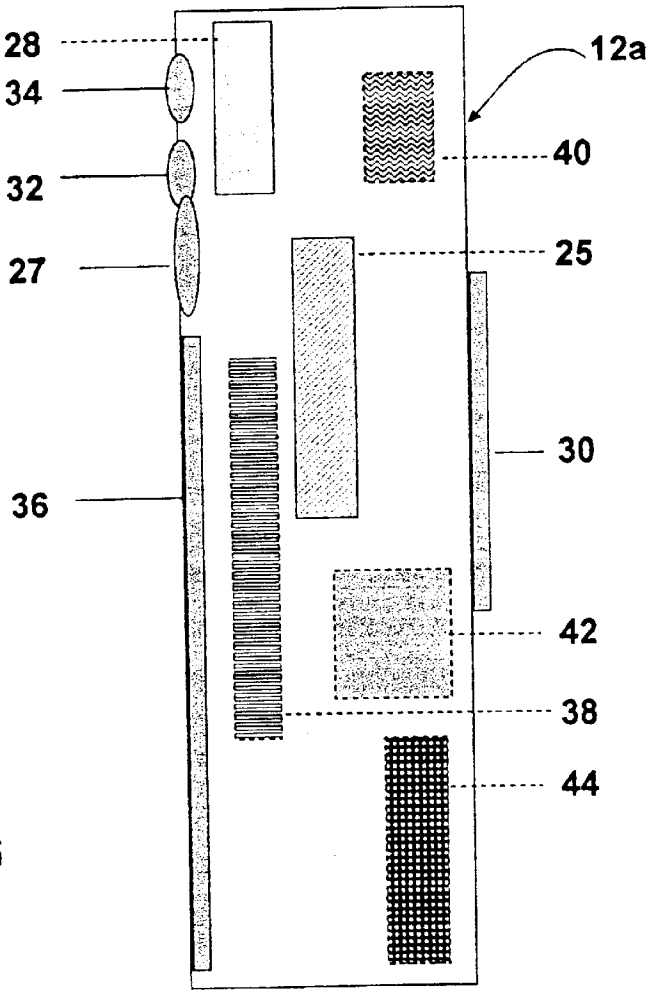
FIG. 6 is a top view of the transmitter unit of FIG. 5.
Figure 7:
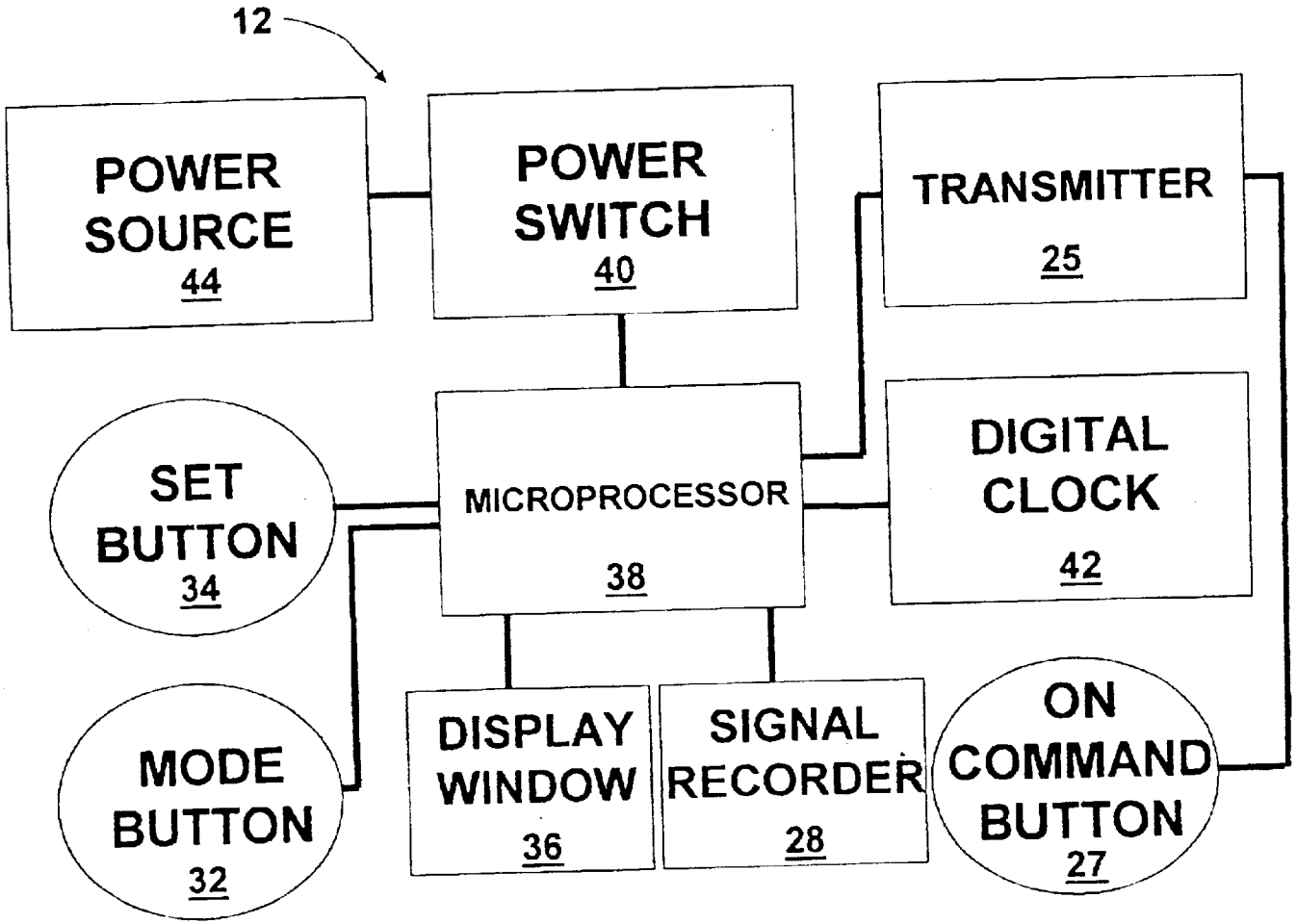
FIG. 7 is a block diagram of the transmitter unit of FIGS. 5 and 6.

As shown in FIGS. 5 and 6, the transmitter unit 12 typically includes a transmitter housing 12*a* which houses or supports the various operational elements of the transmitter unit 12, which operational elements will be hereinafter described with respect to FIG. 7. As shown in FIG. 7, the transmitter unit 12 includes a microprocessor 38, to which is operably connected a power source 44, such as a battery, through a power switch 40 which is used to selectively supply electrical power to the microprocessor 38 and turn the transmitter unit 12 on and off, as hereinafter further described. A transmitter 25 is connected to the microprocessor 38 for transmitting activation signals at selected times as programmed into the microprocessor 38. A display window 36, operably connected to the microprocessor 38, is provided on a face of the transmitter housing 12*a*, as shown in FIGS. 5 and 6, and provides a viewing of preset date, time and time interval settings for activation signals programmed into the microprocessor 38 and to be emitted from the transmitter 25, as hereinafter further described. A mode button 32 is connected to the microprocessor 38 for scrolling a menu of the microprocessor 38 as shown in the display window 36. A set button 34 is connected to the microprocessor 38 to enable a user to select menu options and enter time settings and selections into the microprocessor 38. A digital clock 42 is further connected to the microprocessor 38 to enable the microprocessor 38 to control the date and time of activation signals emitted by the transmitter 25, as well as the length of the time interval to elapse between successive activation signals. An "on command" button 27 may be connected to the transmitter 25 for manual activation of the transmitter 25, as desired. A signal recorder 28 may further be connected to the microprocessor 38 and may include an option on the menu of the microprocessor 38 for receiving and storing a signal of a remote transmitter device (not shown) for the purpose of sending a preset recorded signal to a remote receiver (not shown). This feature would enable the transmitter unit 12 to send preset signals to a remote electronic automobile engine starter device (not shown) or other device to be remotely activated by the remote receiver. While a preferred structure for the transmitter is shown and described herein, those of ordinary skill in the art who have read this description will appreciate that there are numerous other structures for the transmitter and, therefore, as used herein the term "transmitter" should be construed as including all such structures as long as they achieve the desired result of producing and/or transmitting a signal, and therefore, that all such alternative mechanisms are to be considered as equivalent to the transmitter described herein.

A typical arrangement of the various control features on the housing 12*a* of the transmitter unit 12 is shown in FIGS. 5 and 6. Accordingly, the mode button 32, the set button 34 and the "on command" button 27 may be provided together along with the display window 36 on the front face of the housing 11*a*. However, it is understood that the relative positional arrangements of these control elements on the transmitter housing 12*a* is merely illustrative and the elements may have any desired arrangement to facilitate ease in using the transmitter unit 12. As shown in FIG. 6, a removable clip 30 may be provided on the rear face or in any other suitable location on the transmitter housing 12*a* to facilitate removable attachment of the transmitter housing 12*a* to a belt (not shown) or an other article of clothing on the user 3. Alternatively, it is understood that the transmitter housing 12*a* may include straps, loops, magnets (not shown) or any other attachment mechanism known by those skilled in the art to facilitate attachment of the transmitter housing 12*a* to the user 3.

Figure 8:
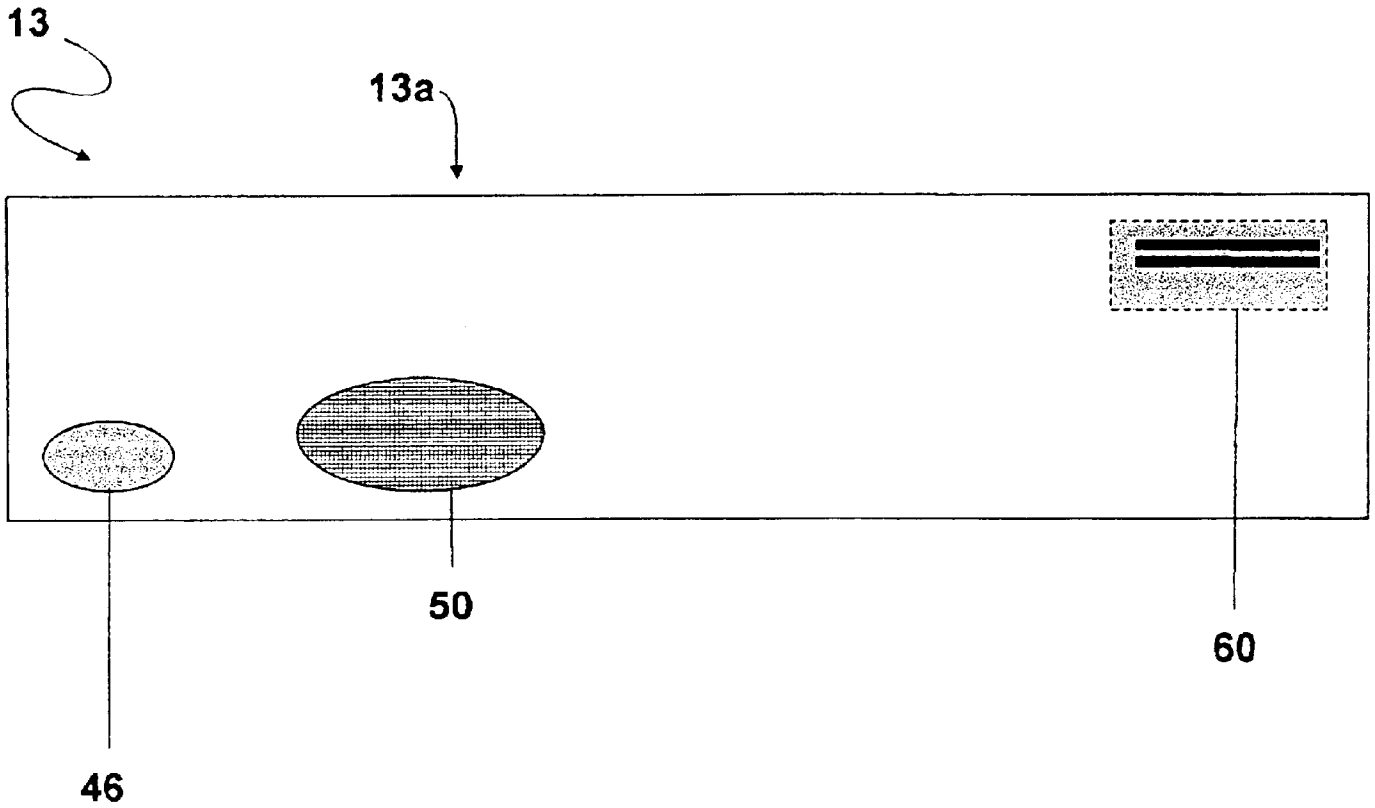
FIG. 8 is a front view of a receiver unit of the remote transmitter/receiver embodiment of the devices of the present invention.
Figure 10:
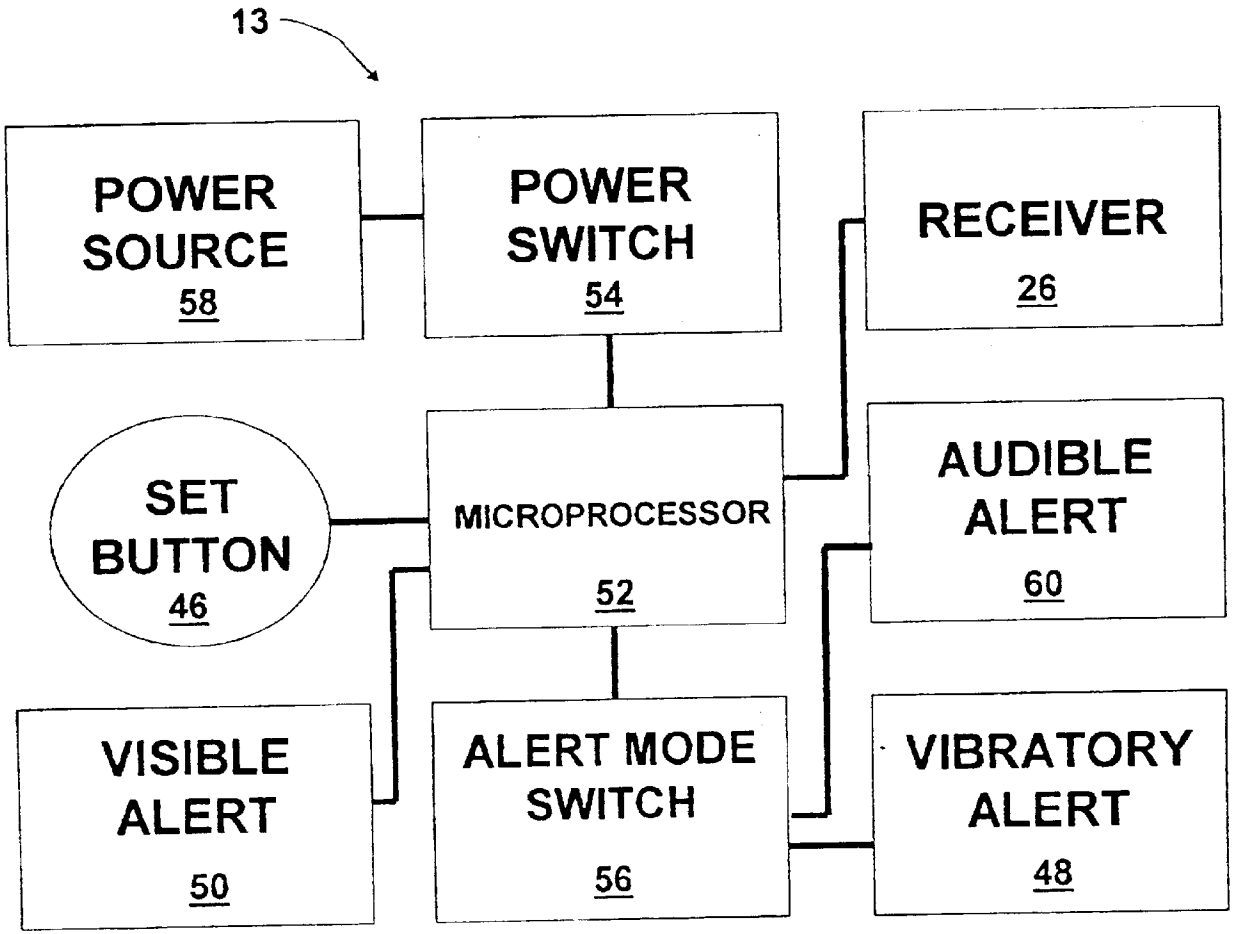
FIG. 10 is a block diagram of the receiver unit of FIGS. 8 and 9.

As shown in FIGS. 8 and 9, the receiver unit 13 typically includes a receiver housing 13*a* which houses or supports the various operational elements of the receiver unit 13, which operational elements will be hereinafter described with respect to FIG. 10. As shown in the block diagram of FIG. 10, the receiver unit 13 includes a microprocessor 52, to which is operably connected a power source 58, such as a battery, through a power switch 54 which is used to selectively supply electrical power to the microprocessor 52 and turn the receiver unit 13 on and off, as hereinafter further described. A receiver 26 is connected to the microprocessor 52 for receiving activation signals from the transmitter 25 of the transmitter unit 12 at times as programmed into the microprocessor 38 of the transmitter unit 12, as heretofore described. A visible alert 50 is typically connected to the microprocessor 52 and is provided on the receiver housing 13*a*, as shown in FIGS. 8 and 9. Various other alert mechanisms such as a vibratory alert 48 and/or an audible alert 60 may additionally be connected to the microprocessor 52 typically through an alert mode switch 56 which is used to select between the vibratory alert 48 and the audible alert 60 as well as any additional alert mechanisms (not shown) which may be connected to the microprocessor 52 through the alert mode switch 56. A set button 46 is connected to the microprocessor 52 to enable a user to terminate an alert mode of the receiver unit 13 after the receiver 26 has received an activation signal or signals from the transmitter unit 12 and as the visible alert 50 and vibratory alert 48 or audible alert 60 emit an alert signal or signals, as hereinafter described. While a preferred structure for the receiver is shown and described herein, those of ordinary skill in the art who have read this description will appreciate that there are numerous other structures for the receiver and, therefore, as used herein the term "receiver" should be construed as including all such structures as long as they achieve the desired result of receiving a signal transmitted by a transmitter, and therefore, that all such alternative mechanisms are to be considered as equivalent to the receiver described herein.

A typical arrangement of the various control features on the receiver housing 13*a* of the receiver unit 13 is shown in FIGS. 7 and 8. Accordingly, the set button 46, the visible alert 50 and the audible alert 60 may be provided together on the front face of the receiver housing 13*a*. However, it is understood that the relative positional arrangements of these control elements on the receiver housing 13*a* is merely illustrative and the elements may have any desired arrangement to facilitate ease in using the receiver unit 13. As shown in FIG. 9, a removable clip 31 may be provided on the rear face or in any other suitable location on the receiver housing 13*a* to facilitate removable attachment of the receiver housing 13*a* to the cell phone 5 (FIG. 1) or other object, person or animal (not shown). Alternatively, it is understood that the receiver housing 13*a* may include straps, loops, magnets (not shown) or any other attachment mechanism known by those skilled in the art to facilitate attachment of the receiver housing 13*a* to the object, person or animal.

Referring next to FIGS. 1 and 5–11, in typical operation the transmitter unit 12 and the receiver unit 13 of the device enable a user 3 (FIG. 1) to locate an object such as a cell phone 5 or any other object, animal or person such as a toddler or to remind a user of the location of the animal, object or person after a preset period of time or on-command. Accordingly, the transmitter unit 12 is first activated by supplying electrical power from the power source 44 to the microprocessor 38, by manipulating the power switch 40 to the "on" position, as described in step S12 of FIG. 11. Next, the mode button 32 is depressed to scroll a menu for the microprocessor 38 as displayed on the display window 36, as described in step S14 of FIG. 11. The menu typically includes such options as date and time settings for the digital clock 42, date and time settings for an activation signal or signals to be emitted by the transmitter 25, as well as the desired length of time to elapse between successive activation signals. Accordingly, the "clock time settings" mode for setting the current date and time for the digital clock 42 is first selected in the menu shown in the display window 36 by depressing the mode button 32, after which the desired date, hour and minutes for the digital clock 42 are set using the set button 34. Next, the "activation date settings" rode for the activation signals to be emitted from the transmitter 25 is selected by depressing the mode button 32, after which the desired date for the activation signals to begin are set using the set button 34. Next, the "activation time settings" mode including a menu of available times for the activation signals to begin is scrolled in the display window 36 by again depressing the mode button 32, after which the desired time for the activation signals to begin are set using the set button 34. Next, an "activation timing" mode for selecting the available lengths of time between successive activation signals, typically in seconds, is scrolled on the menu by depressing the mode button 32 as the available time interval lengths are displayed on the display window 36. When the desired time interval length (for example, 15 seconds) appears in the display window 36, that time interval length is selected and programmed into the microprocessor 38 by depressing the set button 34. Finally, the mode button 32 is depressed again to exit the menu mode of the microprocessor 38. Accordingly, the transmitter unit 12 is programmed to begin emitting the activation signals from the transmitter 25 thereof at the date and time programmed into the microprocessor 38.

After the transmitter unit 12 is activated in the manner heretofore described, the receiver unit 13 is activated for use. Accordingly, as described in step S16 of FIG. 11, the receiver unit 13 is first activated by supplying electrical power from the power source 58 to the microprocessor 52, by manipulating the power switch 54 to the "on" position. Next, as described in step S18 of FIG. 11, the alert mode switch 56 may be used to select either the vibratory alert 48 or the audible alert 60 to be used typically in addition to the visible alert 50. The set button 46 is then depressed and held until the visible alert 50 begins to flash, as described in step S20. This indicates that the receiver unit 13 is in the "learn" mode. Typically, the "on command" button" 27 (FIG. 7) of the transmitter unit 12 is next depressed in order to attach the receiver unit 13 to the digital signal of the transmitter unit 12, as described in step S22. At that point, the visible alert 50 stops flashing, indicating that the receiver unit 13 is no longer in the "learn" mode. Next, the "on command" button 27 of the transmitter unit 12 is again depressed to test and verify that the receiver unit 13 is in the activation signal-receiving mode. A positive test is revealed by activation of the visible alert 50 as well as the selected vibratory alert 48 or audible alert 60 on the receiver unit 13. In the foregoing manner, the receiver 26 of the receiver unit 13 is activated to receive activation signals from the transmitter 25 of the transmitter unit 12 at the preset times programmed into the microprocessor 38 of the transmitter unit 12. Accordingly, as described in step S24, the receiver unit 13 is then secured to the cell phone 5 or other object or to a person or animal (not shown) to be located or kept track of using the transmitter unit 12 and the receiver unit 13.

The receiver unit 13 waits in a "sleep" mode for an on-command or preset timed activation signal from the transmitter unit 12, which activation signal may reach the receiver unit 13 as long as the transmitter unit 12 and the receiver unit 13 are within range of each other. When the microprocessor 38 of the transmitter unit 12 matches the preset or programmed time for initiating emission of the activation signals from the transmitter 25 to emit the actual time as indicated by the digital clock 42, the microprocessor 38 actuates the transmitter 25 to emit the activation signals, which are received by the receiver 26 of the receiver unit 13. Accordingly, upon receiving the first activation signal from the transmitter unit 12, the receiver 26 relays this information to the microprocessor 52, which activates the visible alert 50 and either the vibratory alert 48 or the audible alert 60. The visible alert 50 emits a visual alert signal, and the vibratory alert 48 emits a vibratory alert signal or the audible alert 60 emits an auditory alert signal, depending on which of the vibratory alert 48 and the audible alert 60 was previously selected using the alert mode switch 56. After the desired period of time between activation signals programmed into the microprocessor 38 of the transmitter unit 12 has elapsed, as indicated to the microprocessor 38 by the digital clock 42 of the transmitter unit 12, the microprocessor 38 causes the transmitter 25 to emit a second activation signal which is received by the receiver 26 of the receiver unit 13 and signals the microprocessor 52 to activate the visible alert 50 and either the vibratory alert 48 or the audible alert 60 of the receiver unit 13. The visible alert 50 and the vibratory alert 48 or the audible alert 60 each emits the corresponding alert signal a second time. The alert signals are successively emitted from the receiver unit 13 at spaced intervals corresponding to the time intervals between successive activation signals programmed into the transmitter unit 12. The successive timed alert signals emitted from the receiver unit 13 alert the user 3 to the location of the object, person or animal. Alternatively, the "on command" button 27 may be manually depressed to immediately transmit an activation signal from the transmitter 25 of the transmitter unit 12 to the receiver 26 of the receiver unit 13, to facilitate immediate activation of the visible alert 50 and the vibratory alert 48 or the audible alert 60. After the user 3 finds the object, person or animal to which the receiver unit 13 is attached, the set button 46 is depressed to terminate the alert mode of the receiver unit 13. In similar fashion, the set button 34 of the transmitter unit 12 is depressed to prevent further transmission of activation signals from the transmitter 25 of the transmitter unit 12 and reset the transmitter unit 12 for re-programming and subsequent use.

Figure 14:
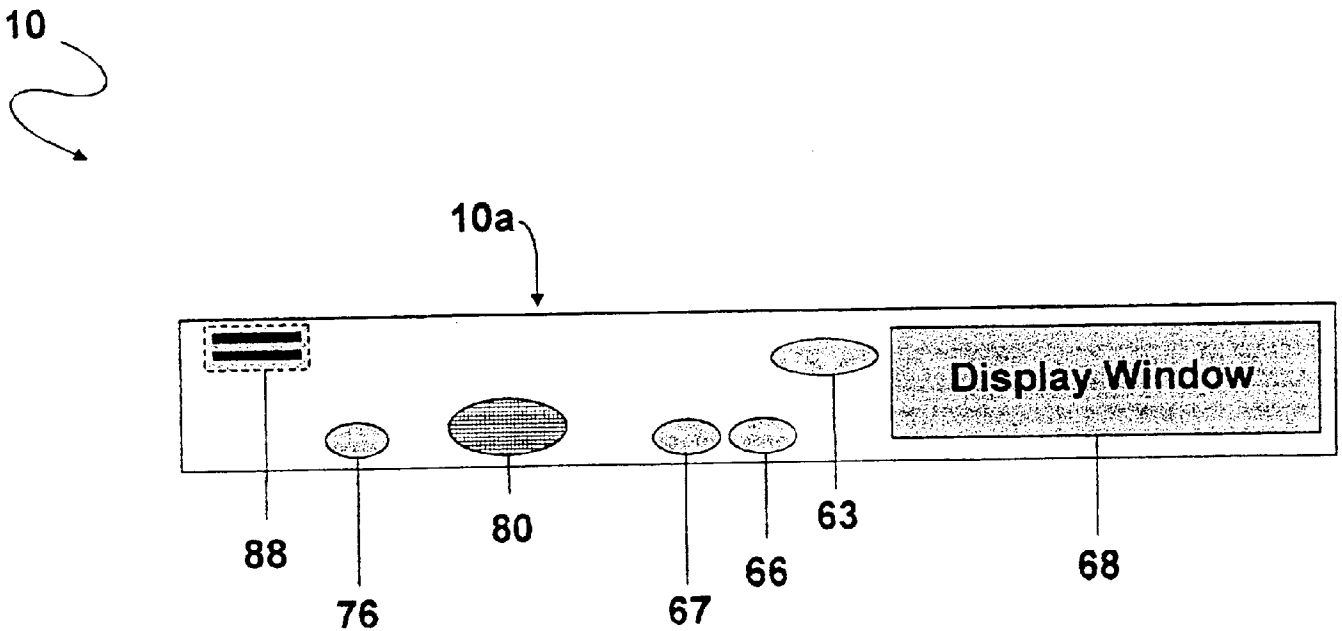
FIG. 14 is a front view of the on-board transmitter/receiver embodiment of the devices of the present invention.
Figure 15:
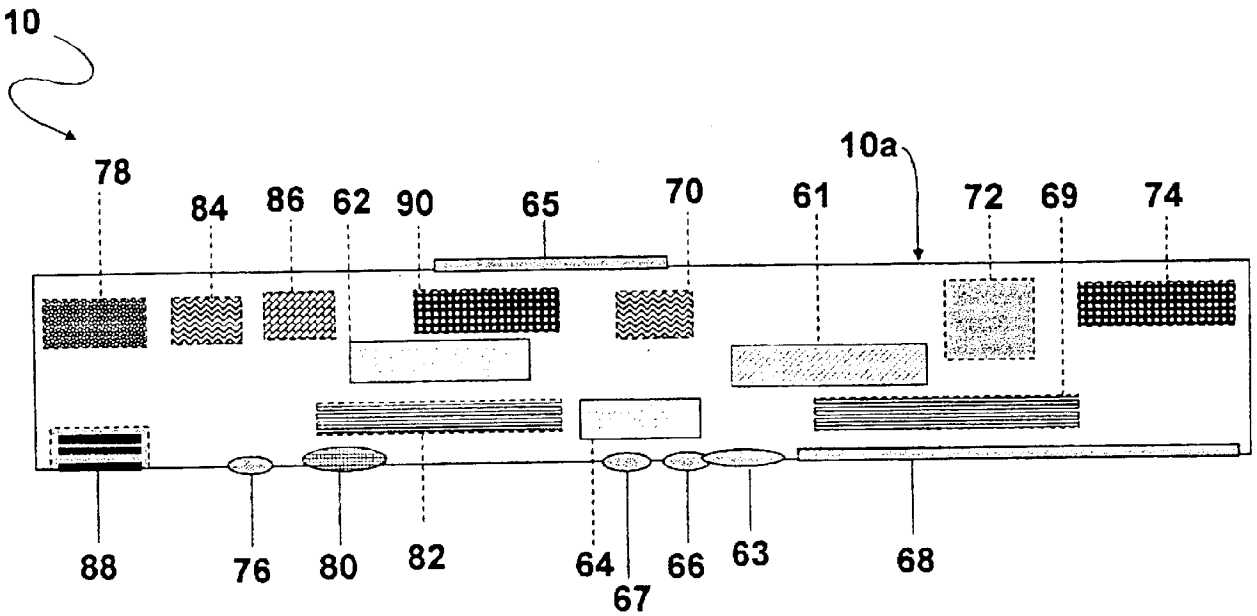
FIG. 15 is a top view of the on-board transmitter/receiver embodiment of the devices illustrated in FIG. 14.

Referring next to FIGS. 14–16B, in still another embodiment an on-board transmitter/receiver embodiment of the devices of the present invention is generally indicated by reference numeral 10 and includes a transmitter unit 92 and a receiver unit 93, each contained within the same housing 10*a* (FIGS. 14 and 15). In use as hereinafter described, the device 10 is attached to an object, person or animal in order to enable a user to locate the object, person or animal or to remind the user of the location of the object, person or animal. The transmitter unit 92 emits activation signals to the receiver unit 93 of the same or of a different, remote device 10, at preset times and at preset time intervals, and typically further includes an on-command feature for emitting on-command activation signals to activate the receiver unit 13 of a remote device 10, as hereinafter further described.

Figure 16A:
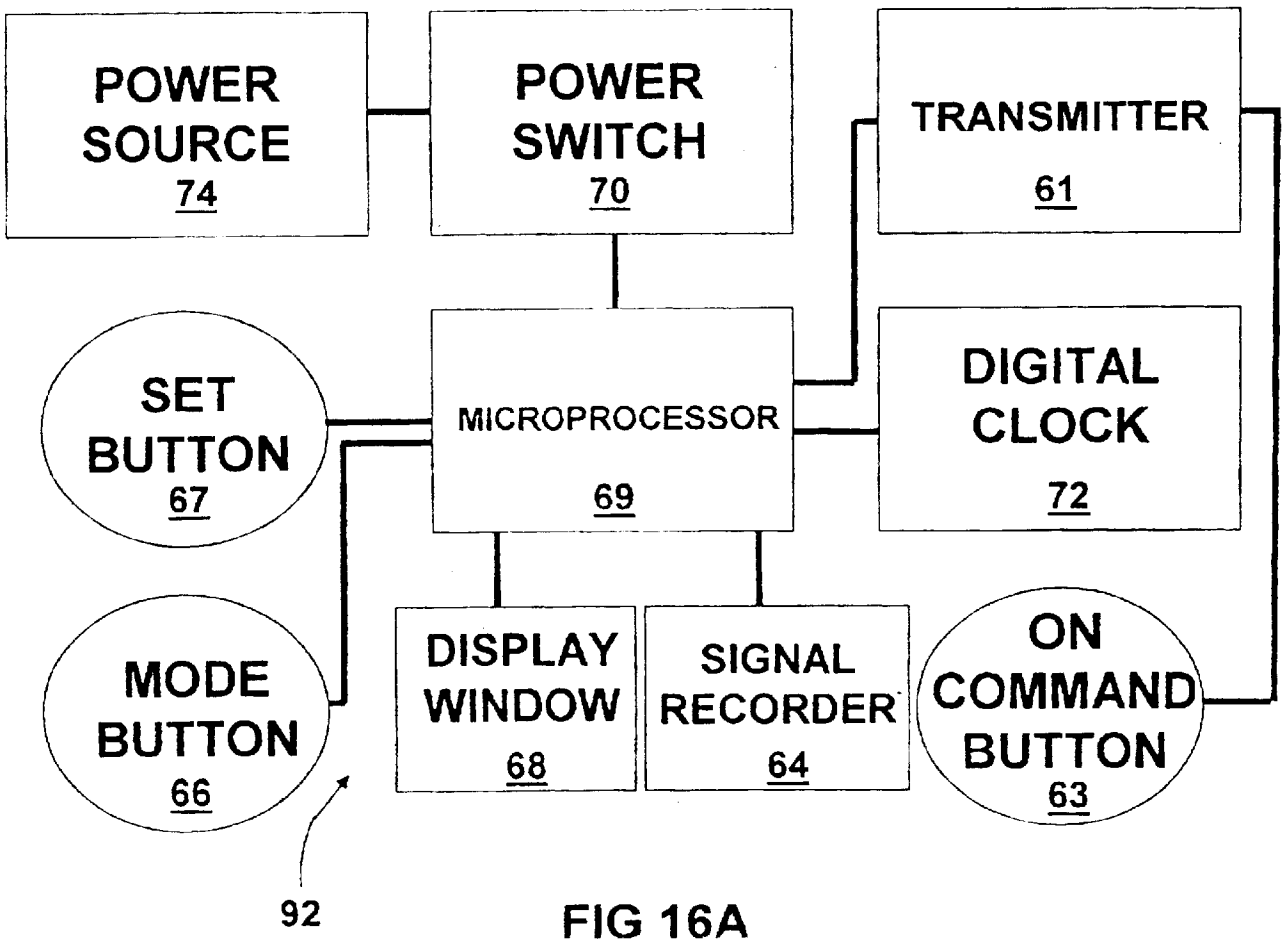
FIG. 16A is a block diagram of the transmitter unit of the on-board transmitter/receiver embodiment of the devices of the present invention.
Figure 16B:
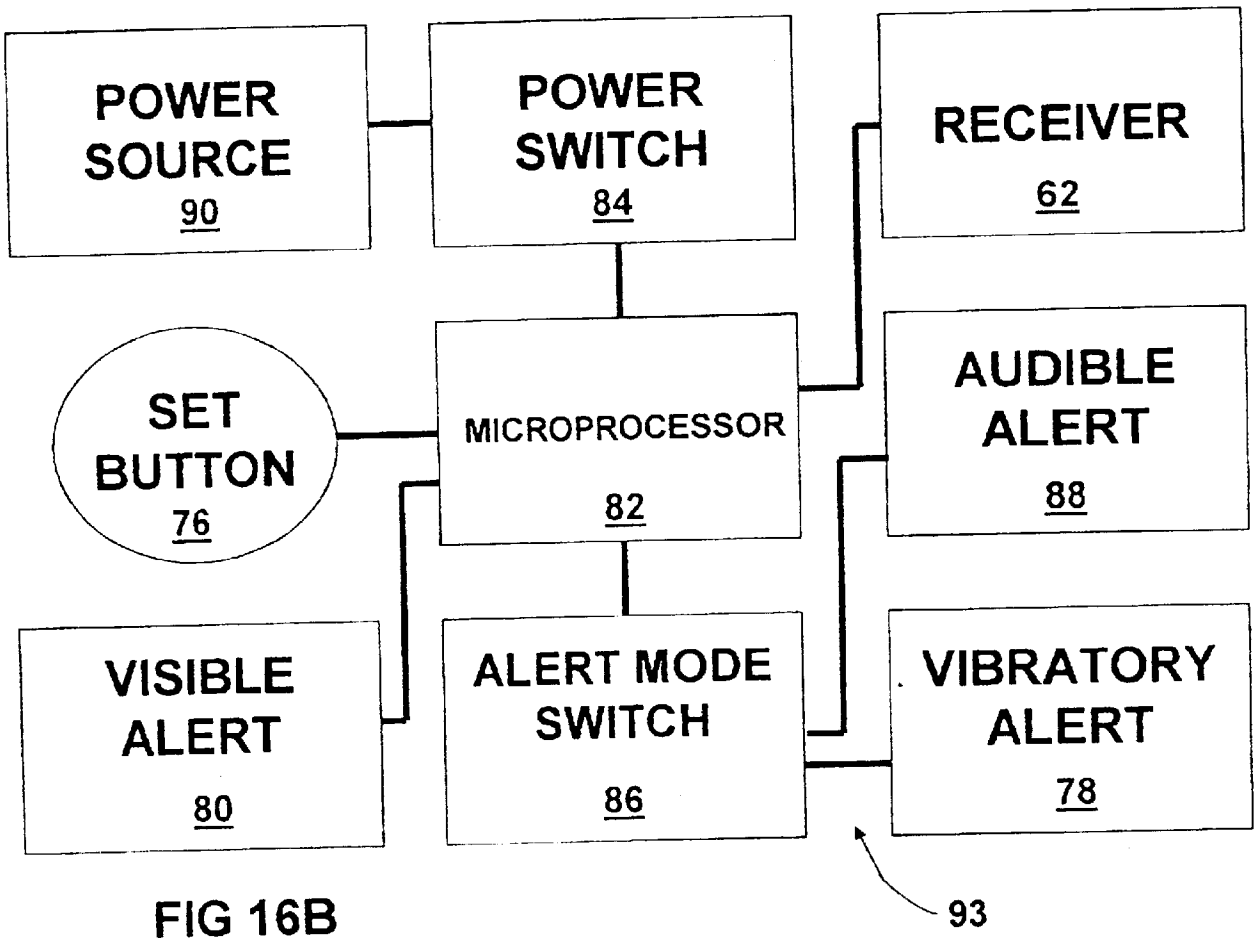
FIG. 16B is a block diagram of the receiver unit of the on-board transmitter/receiver embodiment of the devices of the present invention.

As shown in FIGS. 5 and 6, the device 10 typically includes a housing 10*a* which houses or supports the various operational elements of both the transmitter unit 92 and the receiver unit 93, which operational elements will be hereinafter described with respect to FIGS. 16A and 16B. As shown in FIG. 16A, the transmitter unit 92 includes a microprocessor 69, to which is operably connected a power source 74, such as a battery, through a power switch 70 which is used to selectively supply electrical power to the microprocessor 69 and turn the transmitter unit 92 on and off, as hereinafter further described. A transmitter 61 is connected to the microprocessor 69 for transmitting activation signals at selected times as programmed into the microprocessor 69. A display window 68, operably connected to the microprocessor 69, is provided on a face of the transmitter housing 10*a*, as shown in FIGS. 14 and 15, and provides a viewing of preset date, time and time interval settings for activation signals programmed into the microprocessor 68 and to be emitted from the transmitter 61, as hereinafter further described. A mode button 66 is connected to the microprocessor 69 for scrolling a menu of the microprocessor 69 as shown in the display window 68. A set button 67 is connected to the microprocessor 69 to enable a user to select menu options and enter time settings and selections into the microprocessor 69. A digital clock 72 is further connected to the microprocessor 69 to enable the microprocessor 69 to control the date and time of activation signals emitted by the transmitter 61, as well as the length of the time interval to elapse between successive activation signals. An "on command" button 63 may be connected to the transmitter 61 for manual activation of the transmitter 61, as desired. A signal recorder 64 may further be connected to the microprocessor 69 and may include an option on the menu of the microprocessor 69 for receiving and storing a signal of a remote transmitter device (not shown) for the purpose of sending a preset recorded signal to a remote receiver (not shown). This feature would enable the transmitter unit 92 to send preset signals to a remote electronic automobile engine starter device (not shown) or other device to be remotely activated by the remote receiver.

A typical arrangement of the various control features of the transmitter unit 92 on the housing 10*a* of the device 10 is shown in FIGS. 14 and 15. Accordingly, the mode button 66, the set button 67 and the "on command" button 63 may be provided together along with the display window 68 on the front face of the housing 10*a*. However, it is understood that the relative positional arrangements of these control elements on the housing 10*a* is merely illustrative and the elements may have any desired arrangement to facilitate ease in actuating the transmitter unit 92. As shown in FIG. 6, a removable clip 65 may be provided on the rear face or in any other suitable location on the housing 10*a* to facilitate removable attachment of the housing 10*a* to an object, person or animal (not shown). Alternatively, it is understood that the transmitter housing 12*a* may include straps, loops, magnets (not shown) or any other attachment mechanism known by those skilled in the art to facilitate attachment of the housing 10*a* to the object, person or animal.

As further shown in FIGS. 14 and 15, the housing 10*a* houses or supports the various operational elements of the receiver unit 10, which operational elements will be hereinafter described with respect to FIG. 16B. As shown in the block diagram of FIG. 16B, the receiver unit 93 includes a microprocessor 82, to which is operably connected a power source 90, such as a battery, through a power switch 84 which is used to selectively supply electrical power to the microprocessor 82 and turn the receiver unit 93 on and of, as hereinafter further described. A receiver 62 is connected to the microprocessor 82 for receiving activation signals from the transmitter 61 of the transmitter unit 92 of either the same device 10 or a different, remote device 10 at times as programmed into the microprocessor 69 of the transmitter unit 92, as heretofore described. A visible alert 80 is typically connected to the microprocessor 82 and is provided on the housing 10*a,* as shown in FIGS. 14 and 15. Various other alert mechanisms such as a vibratory alert 78 and/or an audible alert 88 may additionally be connected to the microprocessor 82 typically through an alert mode switch 86 which is used to select between the vibratory alert 78 and the audible alert 88 as well as any additional alert mechanisms (not shown) which may be connected to the microprocessor 82 through the alert mode switch 86. A set button 76 is connected to the microprocessor 82 to enable a user to terminate an alert mode of the receiver unit 93 after the receiver 62 has received an activation signal or signals from the transmitter unit 92 of the same or a different, remote device 10 and as the visible alert 80 and vibratory alert 78 or audible alert 88 emit an alert signal or signals, as hereinafter described.

A typical arrangement of the various control features on the housing 10*a* of the receiver unit 93 is shown in FIGS. 14 and 15. Accordingly, the set button 76, the visible alert 80 and the audible alert 88 may be provided together on the front face of the housing 10*a*. However, it is understood that the relative positional arrangements of these control elements on the housing 10*a* is merely illustrative and the elements may have any desired arrangement to facilitate ease in using the receiver unit 93.

Referring next to FIGS. 13–16B, in typical operation the device 10 enables a user (not shown) to locate an object, animal or person such as a toddler or to remind the user of the location of the animal, object or person after a preset period of time or on-command. Accordingly, the transmitter unit 92 is first activated by supplying electrical power from the power source 74 to the microprocessor 69, by manipulating the power switch 70 to the "on" position, as described in step S26 of FIG. 13. Next, the mode button 66 is depressed to scroll a menu for the microprocessor 69 as displayed on the display window 68, as described in step S28 of FIG. 13. The menu typically includes such options as date and time settings for the digital clock 72, date and time settings for an activation signal or signals to be emitted by the transmitter 61, as well as the desired length of time to elapse between successive activation signals. Accordingly, the "clock time settings" mode for setting the current date and time for the digital clock 72 is first selected in the menu shown in the display window 68 by depressing the mode button 66, after which the desired date, hour and minutes for the digital clock 72 are set using the set button 67. Next, the "activation date settings" mode for the activation signals to be emitted from the transmitter 61 is selected by depressing the mode button 66, after which the desired date for the activation signals to begin are set using the set button 67. Next, the "activation time settings" mode including a menu of available times for the activation signals to begin is scrolled in the display window 68 by again depressing the mode button 66, after which the desired time for the activation signals to begin are set using the set button 67. Next, an "activation timing" mode for selecting the available lengths of time between successive activation signals, typically in seconds, is scrolled on the menu by depressing the mode button 66 as the available time interval lengths are displayed on the display window 68. When the desired time interval length (for example, 15 seconds) appears in the display window 68, that time interval length is selected and programmed into the microprocessor 69 by depressing the set button 67. Finally, the mode button 66 is depressed again to exit the menu mode of the microprocessor 69. Accordingly, the transmitter unit 92 is programmed to begin emitting the activation signals from the transmitter 61 thereof at the date and time programmed into the microprocessor 69.

After the transmitter unit 92 is activated in the manner heretofore described, the receiver unit 93 is activated for use. Accordingly, as described in step S30 of FIG. 13, the receiver unit 93 is first activated by supplying electrical power from the power source 90 to the microprocessor 82, by manipulating the power switch 84 to the "on" position. Next, as described in step S32 of FIG. 13, the alert mode switch 86 may be used to select either the vibratory alert 78 or the audible alert 88 to be used typically in addition to the visible alert 80. The set button 76 is then depressed and held until the visible alert 80 begins to flash, as described in step S34. This indicates that the receiver unit 93 is in the "learn" mode. Typically, the "on command" button" 63 (FIG. 16A) of the transmitter unit 92 is next depressed in order to attach the receiver unit 93 to the digital signal of the transmitter unit 92, as described in step S36. At that point, the visible alert 80 stops flashing, indicating that the receiver unit 93 is no longer in the "learn" mode. Next, the "on command" button 63 of the transmitter unit 92 is again depressed to test and verify that the receiver unit 93 is in the activation signal-receiving mode. A positive test is revealed by activation of the visible alert 80 as well as the selected vibratory alert 78 or audible alert 88 on the receiver unit 93. In the foregoing manner, the receiver 62 of the receiver unit 93 is activated to receive activation signals from the transmitter 61 of the transmitter unit 92 at the preset times programmed into the microprocessor 69 of the transmitter unit 92. Accordingly, as described in step S38, the receiver unit 93 is then secured to the object or to a person or animal (not shown) to be located or kept track of using the device 10.

The receiver unit 93 waits in a "sleep" mode for an on-command or preset timed activation signal from the transmitter unit 92. When the microprocessor 69 of the transmitter unit 92 matches the preset or programmed time for initiating emission of the activation signals from the transmitter 61 with the actual time as indicated by the digital clock 72, the microprocessor 69 actuates the transmitter 61 to emit the activation signals, which are received by the receiver 62 of the receiver unit 93. Accordingly, upon receiving the first activation signal from the transmitter unit 92, the receiver 62 relays this information to the microprocessor 82, which activates the visible alert 80 and either the vibratory alert 78 or the audible alert 88. The visible alert 80 emits a visual alert signal, and the vibratory alert 78 emits a vibratory alert signal or the audible alert 88 emits an auditory alert signal, depending on which of the vibratory alert 78 and the audible alert 88 was previously selected using the alert mode switch 86. After the desired period of time between activation signals programmed into the microprocessor 69 of the transmitter unit 92 has elapsed, as indicated to the microprocessor 69 by the digital clock 72 of the transmitter unit 92, the microprocessor 69 causes the transmitter 61 to emit a second activation signal which is received by the receiver 62 of the receiver unit 93 and signals the microprocessor 82 to activate the visible alert 80 and either the vibratory alert 78 or the audible alert 88 of the receiver unit 93. The visible alert 80 and the vibratory alert 78 or the audible alert 88 each emits the corresponding alert signal a second time. The alert signals are successively emitted from the receiver unit 93 at spaced intervals corresponding to the time intervals between successive activation signals programmed into the transmitter unit 92. The successive timed alert signals emitted from the receiver unit 93 alert the user to the location of the object, person or animal. Alternatively, the "on command" button 63 may be manually depressed to immediately transmit an activation signal from the transmitter 61 of the transmitter unit 92 to the receiver 62 of the receiver unit 93, to facilitate immediate activation of the visible alert 80 and the vibratory alert 78 or the audible alert 88. After the user finds the object, person or animal to which the receiver unit 93 is attached, the set button 76 is depressed to terminate the alert mode of the receiver unit 93. In similar fashion, the set button 67 of the transmitter unit 92 is depressed to prevent further transmission of activation signals from the transmitter 61 of the transmitter unit 92 and reset the transmitter unit 92 for re-programming and subsequent use.

From the above description it can be understood that the devices for locating or keeping track of objects, animals or persons overcomes the shortcomings of conventional devices by providing a transmitter which is capable of storing and making "hands free" preset calls to a receiver unit at desired times. The devices of the invention include a non-transmitter/receiver embodiment which does not require a transmitter or receiver and is capable of storing and making "hands-free" preset alerts at desired times and can be attached to an object, person or animal to remind a user of the location of the object, animal or person or to help the user in locating the object, animal or person. Both the non-transmitter/receiver embodiment and the transmitter/receiver embodiment of the invention may include a visible alert for producing a visual alert signal and typically either an audible alert for producing an audible alert signal or a vibratory alert for producing a vibratory alert signal when a match between a preset time for the alert signals and the current time is made by a timer mechanism on the device.

Furthermore, the devices of the invention are simple in construction and economical in cost to manufacture. It will be understood that the devices of the present invention may have beneficial utility to methods other than those directed toward locating or keeping track of objects, animals or persons.

While the preferred embodiments of the invention have been described above, it will be recognized and understood that various modifications can be made to the invention and the appended claims are intended to cover all such modifications which may fall within the spirit and scope of the invention.

Having described our invention with the particularity set forth above, we claim:

1. A device comprising:

a transmitter for transmitting activation signals;

a timer operably connected to said transmitter for timing transmissions of said activation signals;

a receiver for receiving said activation signals; and at least one alert mechanism operably connected to said receiver for emitting alert signals when said receiver receives said activation signals, respectively;

a set button operably connected to said timer for setting a date and a time for transmission of said activation signals from said transmitter; and a display window operably connected to said set button for displaying the date and the time.

2. The device of claim 1 wherein said at least one alert mechanism comprises a visual alert for emitting a visual alert signal.

3. The device of claim 1 further comprising an "on command" button operably connected to said transmitter for selective manual transmission of said activation signals from said transmitter.

4. The device of claim 1 wherein said timer comprises a digital clock.

5. The device of claim 1 further comprising a transmitter housing and wherein said transmitter is provided in said transmitter housing, and further comprising a receiver housing and wherein said receiver is provided in said receiver housing.

6. The device of claim 1 further comprising a mode button operably connected to said timer for selecting between a "current time set" mode for setting a current time for said timer and an "alert time" mode for setting the date and the time for the activation signals.

7. The device of claim 1 wherein said at least one alert mechanism comprises a visual alert operably connected to said receiver for activation by said receiver and emitting a visual alert signal, an audible alert operably connected to said receiver for activation by said receiver and emitting an auditory alert signal, a vibratory alert operably connected to said receiver for activation by said receiver and emitting a vibratory alert signal, and a selector mechanism operably connected to said audible alert and said vibratory alert and said receiver for selecting between activation of said audible alert and activation of said vibratory alert by said receiver.

8. A device comprising:

a housing;

a transmitter for transmitting activation signals carried by said housing;

a timer carried by said housing and operably connected to said transmitter for timing transmissions of said activation signals;

a receiver carried by said housing for receiving said activation signals; and at least one alert mechanism carried by said housing and operably connected to said receiver for emitting alert signals when said receiver receives said activation signals, respectively;

a set button operably connected to said timer for setting a date and a time for transmission of the activation signals from said transmitter; and a display window operably connected to said set button for displaying the date and the time.

9. The device of claim 8 wherein said at least one alert mechanism comprises a visual alert for emitting a visual alert signal.

10. The device of claim 8 further comprising an "on comnmand" button operably connected to said transmitter for selective manual transmission of the activation signals from said transmitter.

11. The device of claim 8 wherein said timer comprises a digital clock.

12. The device of claim 8 further comprising a mode button operably connected to said timer for selecting between a "current time set" mode for setting a current time for said timer and an "alert time" mode for setting the date and the time for the activation signals.

13. The device of claim 8 wherein said at least one alert mechanism comprises a visual alert operably connected to said receiver for activation by said receiver and emitting a visual alert signal, an audible alert operably connected to said receiver for activation by said receiver and emitting an auditory alert signal, a vibratory alert operably connected to said receiver for activation by said receiver and emitting a vibratory alert signal, and a selector mechanism operably connected to said audible alert and said vibratory alert and said receiver for selecting between activation of said audible alert and activation of said vibratory alert by said receiver.

14. A device comprising:

a visible alert for emitting visible alert signals upon activation;

an audible alert for emitting audible alert signals upon activation;

a vibratory alert for emitting vibratory alert signals upon activation;

a selection mechanism operably connected to said audible alert and said vibratory alert for selecting between activation of said audible alert and activation of said vibratory alert;

a timer operably connected to said visible alert, said audible alert and said vibratory alert for activating said visible alert and a selected one of said audible alert and said vibratory alert at selected times; and a programming mechanism operably connected to said timer for programming the selected times for activating said visible alert and said selected one of said audible alert and said vibratory alert.

15. The device of claim 14 further comprising a display window operably connected to said programming mechanism for displaying the selected times as the selected times are entered into said programming mechanism.

16. The device of claim 15 further comprising a mode button operably connected to said programming mechanism for selecting between a "time set" mode for programming a current time into said timer and an "alert set" mode for programming the selected times for activating said visible alert and said selected one of said audible alert and said vibratory alert into said programming mechanism.

17. The device of claim 15 wherein said programming mechanism comprises a set button for entering the selected times for activating said visible alert and said selected one of said audible alert and said vibratory alert into said programming mechanism.

18. The device of claim 17 further comprising a mode button operably connected to said programming mechanism for selecting between a "time set" mode for programming a current time into said timer and an "alert set" mode for programming the selected times for activating said visible alert and said selected one of said audible alert and said vibratory alert into said programming mechanism.

* * * * *